United States Patent [19]

Sundberg

[11] Patent Number: 4,566,513

[45] Date of Patent: Jan. 28, 1986

[54] ARRANGEMENTS IN BARKING MACHINES

[75] Inventor: Erik Sundberg, Hofors, Sweden

[73] Assignee: Weller Innovation AB, Hofors, Sweden

[21] Appl. No.: 639,790

[22] Filed: Aug. 13, 1984

[30] Foreign Application Priority Data

Mar. 2, 1984 [SE] Sweden ..... 84-01178

[51] Int. Cl.[4] ..... B27L 1/00

[52] U.S. Cl. ..... 144/208 E; 144/340

[58] Field of Search ..... 144/208 R, 208 E, 340

[56] References Cited

U.S. PATENT DOCUMENTS 2,802,495 8/1957 Nicholson ..... 144/208 E 3,361,168 1/1968 Brown ..... 144/208 C 3,667,517 6/1972 Bentley et al. ..... 144/208 E

FOREIGN PATENT DOCUMENTS 758399 5/1967 Canada ..... 144/208 E

*Primary Examiner*—W. D. Bray

*Attorney, Agent, or Firm*—Kinzer, Plyer, Dorn & McEachran

[57] ABSTRACT

A barking machine having a hollow rotor (1) through which logs to be barked are fed is provided with arms (6) which are pivotally mounted on the rotor (1) and which carry barking tools (5). Spring means are used for bringing the barking tools into abutment with the log surfaces. According to the invention these spring means comprise hysteresis-free gas springs (16) arranged to work at a pressure above 25 bar.

8 Claims, 6 Drawing Figures

4
14
10
13
1
12
10
9
6
3
2
4
8
5
4
14
15
17
16
20
19
22
26
21
23
14
15
29
30
18a
18b
18
28
16

ARRANGEMENTS IN BARKING MACHINES

The invention relates to an arrangement in a hollow-rotor type barker or rotation ring barker, in which logs to be barked are fed through the rotor or ring and the bark is removed by means of barking tools which are located around said logs and which are carried by pivotable arms which are acted upon by spring means arranged to forcefully urge the barking tools into abutment with the logs.

One requirement of such spring means is that it shall have but very low inherent damping properties, i.e. it shall not exhibit any appreciable hysteresis. In addition, the spring means shall preferably have small dimensions and adjustable spring characteristics. The low inherent damping characteristics are necessary in order to enable the barking tools, which in hitherto known constructions are provided with a pointed tip which removes the bark, to follow the outer contours of a log, which contours are often highly irregular, without "jumping", and to enable the abutment pressure or tip pressure to be held substantially constant both when tensioning the spring means and when relaxing the same, at mutually similar diameters. The aforementioned adjustability of the spring characteristics is necessary in order to be able to urge the tip of a barking tool against the log surface at a given pressure throughout the whole range of log dimensions for which the barking machine is designed, and to enable adjustments to be made to suit differing types of bark.

To these ends, a number of differing spring arrangements have been tested and brought into use. Known spring arrangements designed to exert pressure upon the aforesaid barking tools can be divided into the following groups:

1. rubber belts or tubes;
2. hydraulic piston-cylinder devices connected to liquid-gas accumulators;
3. steel springs; and
4. pneumatic piston-cylinder devices connected to pressurized-air sources located externally of the barking machine.

Spring arrangements of the kind in which the spring element comprises rubber belts or the like have very high inherent damping, hysteresis, and with such arrangements it is possible, at normal temperatures, to lose from 30–50% of the tool tip-pressure, depending upon the quality of the rubber used, during transition of the tool from an outwardly directed movement to an inwardly directed movement. The tip pressure can even be lost completely, when the temperature is very low. This means that the tool tip may temporarily lose contact with the surface of the log, subsequent to passing a knot, twig or some other raised surface for example. This results in unbarked patches. When the pointed tool-tip is again brought into contact with the surface of the log, the force imparted to the tool is so great that the tip will often penetrate the bark layer and enter the wood therebeneath. Because of the angle of abutment of the tool with the log surface, there is produced upon movement of the log surface relative the tool an upwardly directed force which accelerates the tool outwards, thereby again to lift the tool from the log surface, leaving non-barked patches as a result thereof. This phenomenon is repeated continuously when the log surfaces are irregular. In addition to unsatisfactory barking results, log surfaces become torn and large quantities of wood are lost. Despite these drawbacks, however, such spring arrangements, for example of the kind described in U.S. Pat. No. 2,786,459 have hitherto been used, because the other types of spring arrangements are encumbered with other and more difficult disadvantages. In order to reduce the consequences of hysteresis to the greatest extent possible, however, it is necessary to run the barking machine at low speeds, which means that a barking operation takes a long time to complete and therewith increases production costs.

Although spring arrangements based on the use of steel springs have low inherent damping, hysteresis, and consequently are not encumbered with hysteresis related problems, one serious disadvantage with steel springs, prohibiting their practical use, is that in order to obtain the requisite spring force, the springs must be given large physical dimensions, which in turn means that the spring arrangements are greatly affected by the centrifugal forces created as the rotor rotates, so as to result in phenomena similar to those caused by hysteresis.

Pneumatic piston-cylinder devices have very low inherent damping properties, and theoretically are well suited as spring elements in barking machines. The use of pneumatic piston-cylinder devices, however, requires the provision of a compressor or some other pressurized-air source. Because such pressurized-air sources are relatively bulky and have a relatively large mass, they cannot be mounted on the rotor, but must be placed externally of the barking machine. Consequently, the pressurized air must be supplied to the cylinders via slide couplings, which due to the particular construction of hollow-rotor type machines must be given extremely large diameters. It is totally impossible to render such slide couplings completely free of leakage and consequently it is necessary to work at relatively low pressures, by which is meant pressures of the order of six (6) bars or less. This necessity of working at low pressures, means the cylinders must consequently be given extremely large diameters and that the machines must be made unnecessarily large, resulting in more expensive machines. The use of separate compressor plants means higher investment costs and high energy costs.

Consequently, a prime object of the invention is to provide a spring arrangement of the abovementioned kind which exhibits low inherent damping, which has a spring characteristic which can be readily adapted to prevailing power requirements, and which has small physical dimensions.

This object is achieved by means of the present invention, which is mainly characterized in that each spring arrangement comprises a gas spring incorporating a piston-cylinder device which is pivotally mounted on the rotor and which is arranged to operate at gas pressures above 25 bars.

Such a gas spring has practically no hysteresis and will consequently follow completely all irregularities of the surface of a log, and exert on a barking tool a constant or substantially constant tool pressure at a predetermined diameter, irrespective of the magnitude of said irregularities and irrespective of whether the tools move inwardly or outwardly with respect to the centre of the rotor. The essential factor is that it is possible to use extremely high gas pressures, preferably within the range of 60–150 bars, with the aid of small piston-cylinder devices.

The gas spring, the spring characteristic of which is not affected by centrifugal forces, is a cylinder-type pressure spring which is filled with gas and with which the force on the piston rod is determined by the gas pressure, which in the present case is high, and the diameter of said rod. Since the gas pressure is one of the force determining parameters, the tool force can be adjusted as required, i.e. in accordance with the type of bark to be removed, by altering the gas pressure in respective cylinders. This change in gas pressure can be accomplished by connecting all cylinders temporarily to an external pressure source which is common to all cylinders. Thus, the gas springs can be charged with gas to a given pressure in a single operation, such that all barking tools will bear against logs of similar diameter at mutually identical tool pressures, as distinct from the case with known spring arrangements, which only exert precisely the same pressure on all said tools under exceptional circumstances. As will be understood, it is also possible to regulate the pressure in respective individual cylinders to precise levels.

As beforementioned, a gas spring operating at pressures according to the above obtains small physical dimensions and consequently can be readily incorporated in the rotor part of the barking machine at reasonable costs. The absence of hysteresis, or in all events the presence of only negligible hysteresis, means that the tools will steadily follow the surface of a log and effectively strip the bark therefrom.

The characterizing features of the invention are set forth in the following claims. A barking machine according to the invention will now be described in more detail with reference to the accompanying drawings, in which FIG. 1 is a simplified illustration of the most essential parts of a barking machine according to the invention, and is a partially cut-away view seen from the log infeed side of the machine;

Figure 1:
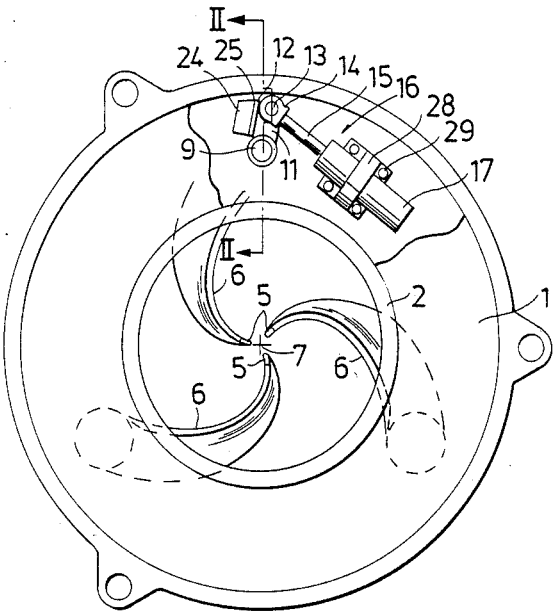
Figures 2, 3, 4:
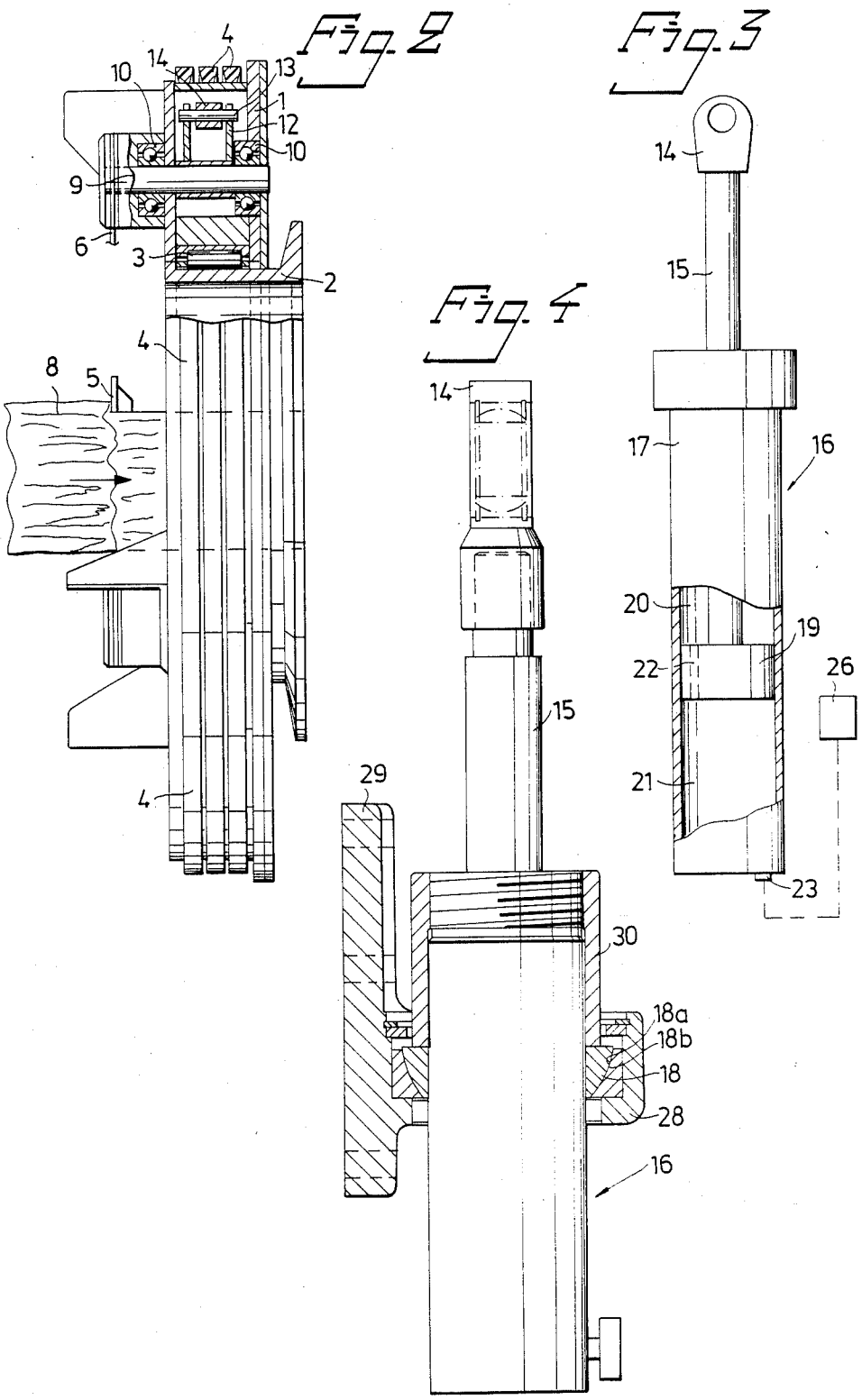
FIG. 2 is a view taken on the line II—II in FIG. 1.
FIG. 3 is a simplified view of a partially cutaway gas spring.
FIG. 4 illustrates bearing means for a gas spring.

In FIGS. 1 and 2 the reference 1 identifies an annular rotor which is journalled in a bearing 3 for rotation in a frame 2. In the illustrated embodiment, the rotor 1 is driven by a motor (not shown) via belts 4. Logs 8 are fed sequentially in the direction of their long axes through the centre of the rotor 1, by means of conveyors or some other suitable transport means (not shown). Mounted on the rotor 1 are a number of barking tools 5 (three in the illustrated embodiment), which are carried by pivotable arms 6. In the illustrated embodiment, the tools 5 are assumed to be inserts detachably held by the arms 6. The tools 5 on the free ends of the arms 6 are urged continuously towards the centre of rotation 7 of the rotor 1. The barking tools 5 may be of any kind suitable for removing the bark from the logs 8 through a cutting action. The form of the pivotable arms 6 is such that when coming into contact with the end of an incoming log 8, they are automatically swung outwards, so as to glide over said end and up onto the surface of the bark. The arms 6 have shafts 9 which are journalled in bearings 10 arranged in the rotor 1. The shafts 9 are connected together by means of levers 11 having outwardly extending arms 12. Each such arm 12 is of bifurcate configuration and has a shaft 13, on which there is pivotally mounted an end piece 14 of the piston rod 15 of a gas spring 16. The gas spring 16 has an outer cylinder 17, which is incorporated in a bearing house 28 mounted on a plate 29 connected to the rotor, and housing a bearing 18. The bearing 18 has two mutually coacting bearing surfaces **18*a*, 18*b*, which are arranged to permit the cylinder to swing within a cone-shaped area. In order to restrict the influence of centrifugal forces to the greatest possible extent, the angular radial bearing 18 is located as close as possible to the centre of gravity of the gas spring 16, with the aid of a ring nut 30 (FIG. 4). The gas spring 16, which is manufactured by Strömsholmens Mekaniska Verkstad AB, Tranås, Sweden, is illustrated in greatly simplified fashion in FIG. 3. As will be seen from this figure, the piston rod 15 is connected to a piston 19 slidably arranged in the gas-tight cylinder 17. As is known, the piston 19 is arranged to permit gas to flow between the two chambers 20, 21 defined by the upper and lower piston surface respectively, the chambers thereby being under the same prevailing pressure. Communication between the chambers 20 and 21 is effected through the passage 22 in piston 19. As mentioned in the introduction, the force is determined by the prevailing gas pressure in the cylinder and by the diameter of the piston rod. The force of the gas spring can be varied, by varying the pressure of the gas, which may be, for example, nitrogen qas or demoisturized air. The spring characteristic is determined by the volume of the chambers 20 and 21** and the diameter of the piston rod.

As indicated in FIG. 3, each cylinder 17 is provided with a valve means 23, through which gas can be supplied from a gas source 26 and removed from the cylinder, thereby to change the load on the piston rod.

Figure 5:
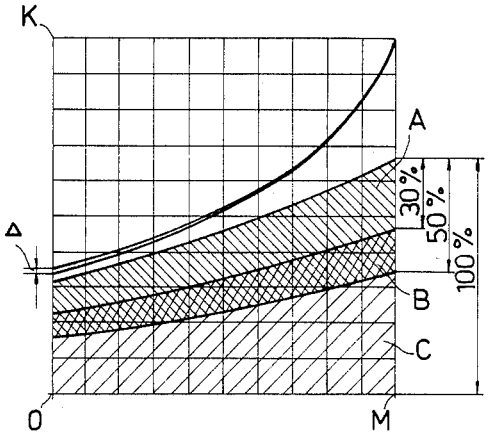
FIG. 5 is a diagram illustrating the hysteresis of a gas spring having a gas pressure according to the invention, and the hysteresis of a conventional rubber spring.

FIG. 5 illustrates the respective hysteresis factor of a rubber spring and of a gas piston-cylinder device according to the invention. By hysteresis is meant here the force delay which occurs during the relaxation or detensioning of a spring arrangement and which is caused by the inherent damping properties of the spring material. This inherent damping is due to both the temperature of the spring element and to the quality of the rubber from which it is made. In FIG. 5, tensioning of the spring element is plotted along the X-axis, the origin O showing the smallest tension and the point M the maximum tension. Along the Y-axis there is plotted the static force developed by the spring arrangement, varying between a smallest force at origin O and a maximum force K. The shaded area A shows the temporary reduction in force of a rubber spring during a spring-relaxing sequence, and the hatched area B shows the possible variation which this reduction in force may exhibit as a result in variations in quality of the rubber material. It will be seen that hysteresis of a rubber spring can vary between 30 and 50 of the maximum force at normal temperatures. The area B also shows, together with the area C, the variation, 30–100%, in force reduction caused by a force delay at temperatures, which are lower, or considerably lower, than normal temperatures. In practice, the force delay at low temperatures results in a pure force reduction. Hysteresis of a gas spring working with pressure in accordance with the invention can only be measured with difficulty, and is indicated in the diagram by means of the reference Δ.

Figure 6:
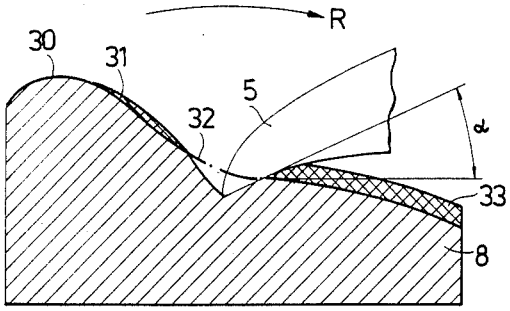
FIG. 6 illustrates the functioning of a tool where the tool force is applied by means of a rubber spring.

FIG. 6 illustrates the problems mentioned in the introduction and caused by hysteresis of the spring material, which material may comprise rubber belts or like spring elements. The reference R identifies the direction of movement of the rotor 1, and thus the tools 5, in relation to the logs 8. When the tool 5 passes a raised surface 30 on the log 8, the hysteresis factor will cause the tip pressure of the tool 5 to be relatively low in comparison with the tip pressure on the raised surface 30, which means that the area 31 will not be completely barked. As soon as the "delay" in the rubber element has ceased, the force on the tool tip will increase, causing the tool tip to penetrate the wood when it contacts the surface 32 thereof. As beforementioned, because the tool 5 lies against the log surface at an angle $\alpha$, the tool will be lifted upon relative movement between log and tool, resulting in a further non-barked area 33. The only possibility of preventing the occurrence of non-barked surfaces and damaged wood is to lower the rotor speed to a minimum at which hysteresis losses can be counteracted. This will result in an unreasonably low barking capacity, however.

A spring arrangement according to the invention enables the tool to follow the contours of a log substantially precisely, and completely eliminates the risk of the tool "jumping", provided that each gas spring is given a pressure of the aforementioned magnitude. Practical tests have shown that the invention enables the rotor to be driven at high speeds, i.e. provides a high barking capacity, without risk of the tools being caused to oscillate or to jump in the manner illustrated in FIG. 6. In addition to impairing the wood, these oscillations occurring with the spring elements used hitherto, i.e. rubber springs, also results in rapid fatigue of the tool arms and their force transmission means and suspension means. These disadvantages can also be eliminated by means of the present invention.

I claim:

1. In an improved log barking machine for scraping bark from logs of various sizes and shapes, said machine having a frame, an annular rotor adapted to receive a log therethrough, means mounted on said frame and supporting said rotor for rotation, a plurality of barking tools each carried by an arm, each arm is pivotally mounted on the rotor for generally radial movement, the improvement comprising a gas spring cylinder for each arm biasing the barking tool into contact with the log, said gas spring cylinder having a self-contained supply of pressurized gas, a double acting differential piston and rod located in the cylinder, and a gas passage extending through the cylinder to equalize pressure on opposite sides of the piston to maintain a constant bias on the arm.

2. The log barking machine of claim 1 in which the gas is at a pressure of more than 25 bars.

3. An arrangement according to claim 1, characterized in that the gas pressure is preferably 60–150 bars.

4. An arrangement according to claim 1, characterized in that each gas spring (16) is journalled, within the vicinity of its centre of gravity, in a bearing (18) which enables the gas spring to pivot in any direction.

5. An arrangement according to claim 1, characterized in that each gas spring (16) is provided with a valve (23) which can be connected to a gas source (26) and which is intended for setting the gas pressure of the gas spring.

6. An arrangement according to claim 3 charcterized in that each gas spring (16) is journalled, within the vicinity of its center of gravity, in a bearing (18) which enables the gas spring to pivot in any direction.

7. An arrangement according to claim 3 characterized in that each gas spring (16) is provided with a valve (23) which can be connected to a gas source (26) and which is intended for setting the gas pressure of the gas spring.

8. An arrangement according to claim 4 characterized in that each gas spring (16) is provided with a valve (23) which can be connected to a gas source (26) and which is intended for setting the gas pressure of the gas spring.

* * * * *